US006793805B2

(12) United States Patent
Didillon et al.

(10) Patent No.: US 6,793,805 B2
(45) Date of Patent: Sep. 21, 2004

(54) PROCESS FOR CAPTURING MERCURY AND ARSENIC COMPRISING EVAPORATION THEN CONDENSATION OF A HYDROCARBON-CONTAINING CUT

(75) Inventors: Blaise Didillon, Francheville (FR); Carine Petit-Clair, Montesson (FR); Laurent Savary, Rueil-Malmaison (FR)

(73) Assignee: Institut Francais du Pétrole, Rueil-Malmaison (FR)

( * ) Notice: Subject to any disclaimer, the term of this patent is extended or adjusted under 35 U.S.C. 154(b) by 603 days.

(21) Appl. No.: 09/893,602

(22) Filed: Jun. 29, 2001

(65) Prior Publication Data

US 2002/0139720 A1 Oct. 3, 2002

Related U.S. Application Data

(63) Continuation-in-part of application No. 09/849,520, filed on May 7, 2001, now abandoned.

(30) Foreign Application Priority Data

May 5, 2000 (FR) ..... 00 05839

(51) Int. Cl.[7] ..... C10G 67/00

(52) U.S. Cl. ..... 208/251 H; 208/251 R; 208/295; 208/296; 208/299; 208/307

(58) Field of Search ..... 208/251 H, 251 R, 208/295, 296, 299, 307

(56) References Cited

U.S. PATENT DOCUMENTS

| | | | |
|---|---|---|---|
| 4,094,777 | A | 6/1978 | Sugier et al. |
| 4,911,825 | A | 3/1990 | Roussel et al. |
| 5,384,040 | A | 1/1995 | Mank et al. |
| 5,989,506 | A | 11/1999 | Markovs |

OTHER PUBLICATIONS

JP 1993000267933 Patent Abstract of Japan, Publication No. 07103377 A—Water Leakage Detecting Flexible Fitting, Sankei Giken:KK, Hayashi Kanefusa et al., application No. 05267933 filed Sep. 30, 1993.

*Primary Examiner*—Walter D. Griffin
*Assistant Examiner*—James Arnold, Jr.
(74) *Attorney, Agent, or Firm*—Millen, White, Zelano & Branigan, P.C.

(57) ABSTRACT

A process for capturing mercury and possibly arsenic comprising at least:

a) vaporising (or flashing, step a1) then condensing a hydrocarbon-containing feed (step a2) without separating said feed;

b) treating the effluent from step a2 comprising at least one step for bringing said effluent into contact with hydrogen and a catalyst, and optionally capturing arsenic;

c) a step consisting in passing the effluent from step b) over a mercury capture mass.

12 Claims, No Drawings

PROCESS FOR CAPTURING MERCURY AND ARSENIC COMPRISING EVAPORATION THEN CONDENSATION OF A HYDROCARBON-CONTAINING CUT

This application is a continuation-in-part of U.S. application Ser. No. 09/849,520, now abandoned filed May 7, 2001.

The invention relates to a process for eliminating mercury and possibly arsenic from a hydrocarbon-containing feed, comprising at least: a first step for vaporising the feed, followed by condensing the vaporised feed, then a catalytic step carried out in the presence of hydrogen that can possibly capture arsenic, and a step for adsorbing mercury on a mercury capture mass.

PRIOR ART

Liquid condensates (by-products from gas production) and certain crude oils are known to contain a variety of metallic trace compounds, usually in the form of organometallic complexes. Such metallic compounds are usually poisons for the catalysts used in processes for transforming such cuts into commercial products. Mercury is particularly poisonous as regards the activity of precious metals. It is also highly corrosive towards aluminium parts, and to seals and welds.

It is thus advantageous to purify feeds for sending to processes for transforming condensates or crudes to avoid entraining mercury and possibly arsenic. Purification of the feed upstream of treatment processes can protect the whole of the facility.

The applicant has previously proposed a process for eliminating mercury from hydrocarbons acting as feeds for a variety of treatment processes. U.S. Pat. No. 4,911,825 describes a process for capturing mercury and possibly arsenic using a two-step process. The first step consists of bringing the feed, in the presence of hydrogen, into contact with a catalyst comprising at least one metal selected from the group formed by nickel, cobalt, iron and palladium. Mercury is not, or is only slightly, captured by the catalyst but it is activated on that catalyst so as to be captured in a second step by a mass comprising sulphur or a metallic sulphide.

U.S. Pat. No. 5,384,040 describes a process for eliminating mercury from a liquid hydrocarbon feed, comprising two steps—a step for transforming compounds containing mercury into elemental mercury, and a step for fractionating the effluent from the first step. The metallic mercury from the first step is distributed in at least two cuts: at least one light fraction that is enriched in mercury and has a boiling point of less than 180° C., which is treated using a metallic mercury adsorption mass, and at least one heavy fraction with a boiling point of more than 180° C., with a reduced mercury content.

Japanese patent JP-07-103377 describes a process for eliminating mercury contained in liquid hydrocarbons comprising a first feed heat treatment step carried out at a temperature of 200° C. or more to decompose all of the mercury species present in the feed to mercury metal, then a second step consisting of bringing the heated liquid hydrocarbon into contact with an adsorbent including a molybdenum sulphide at a temperature not exceeding 200° C.

U.S. Pat. No. 4,094,777 describes a process for capturing mercury in its metal form, in the gas or liquid phase using an adsorbent mass comprising a copper sulphide and possibly a silver sulphide disposed in a fixed bed.

U.S. Pat. No. 5,989,506 describes a process for removing mercury from a feed. This process comprises fractionation of the feed into a gas fraction comprising C1–C3 hydrocarbons and water and a liquid fraction comprising C3+ hydrocarbons and water, then a separate treatment of the two fractions using regeneratable adsorbents in a sequential manner.

DESCRIPTION OF THE INVENTION

The invention concerns a process for capturing mercury and possibly arsenic comprising at least:

a) vaporising (or flashing, step a1) then condensing the hydrocarbon-containing feed (step a2) without separating said feed;

b) treating the effluent from step a2), comprising at least one step for bringing said effluent into contact with hydrogen and a catalyst;

c) a step consisting of passing the effluent from step b) over a mercury capture mass.

By vaporising the feed then condensing it, sludge is separated from said feed. Further, this step can practically completely or completely eliminate mercury from this sludge. The vaporised effluent is then condensed into a single cut, free of sludge, but slightly enriched with the mercury from the sludge.

The process according to the invention thus comprises a step for vaporising the feed to be treated by heating (step a1) to temperatures that are preferably close to the end point of the feed in question, i.e., close to the temperature beyond which all of the feed has been vaporised with the exception of a residue that is general pasty and essentially constituted by sludge. These temperatures are generally in the range 20° C. to 600° C.

One of the aims of the process of the invention is to eliminate the sludge present in the feed and to avoid separate treatments of the several fractions resulting from the feed. An increase in the concentration of mercury has been observed in the cut obtained after evaporation by heating. This increase in the mercury content is obtained by decomposition of the organometallic mercury compounds and/or thermal decomposition of sludge containing mercury.

After condensing the vaporised feed, the condensate obtained is sent to a catalytic treatment step (step b) which can activate the mercury compounds and can also possibly capture arsenic, preferably eliminating at least 90% by weight of the arsenic contained in the condensate, more preferably at least 95% by weight, still more preferably at least 98% by weight, and highly preferably at least 99% by weight. Step b) is followed by mercury capture on an adsorbent mass (step c)), which preferably eliminates at least 90% by weight of the mercury contained in the condensate, more preferably at least 95% by weight, still more preferably at least 98% by weight and highly preferably at least 99% by weight.

Vaporisation/condensation steps a1) and a2) advantageously concentrate in the heaviest fraction particles in suspension which constitute the sludge and are formed from solid mineral compounds (for example silica) and/or heavy hydrocarbons in the condensed form. Further, the mercury previously present in the metallic or organometallic form in this sludge is thermally decomposed during vaporisation.

The invention thus concerns a process for capturing mercury and possibly arsenic comprises at least:

a) vaporising (or flashing, step a1)) said hydrocarbon feed followed by condensing. This vaporisation is carried out in a temperature range generally in the range about 20° C. to 600° C. and at a pressure in the range 0.1 to 5 MPa, more preferably in the range 0.1 to 2 MPa. The temperature is selected as a function of the nature of the properties of said feed, i.e., as a function of the end point of the feed. In general, the temperature selected is slightly lower or slightly higher than the end point. Preferably, the temperature is in the range from the temperature of the end point of the feed reduced by 20° C. to the temperature of the end point of the feed increased by 20° C., more preferably in the range from the end point reduced by 10° C. to the end point increased by 10° C. The effluent vaporised during step a1) is then condensed (step a2) at a temperature lower than that of step a1) and advantageously in the range −10° C. to 500° C. and at a pressure in the range 0.1 to 5 MPa, more preferably in the range 0.1 to 2 MPa.

b) A step (step b)) comprising bringing the heavy cut into contact with hydrogen in the presence of a catalyst. This step transforms mercury organometallics, in other words it activates the mercury and can also optionally capture arsenic. Advantageously, for example, the Applicant's process described in U.S. Pat. No. 4,911,825 can be used, which consists of bringing the feed into contact with hydrogen in the presence of a catalyst comprising at least one metal selected from the group formed by nickel, cobalt, iron and palladium. Preferably, at least 50% of said metal is in the reduced state, i.e., in the metallic state, but it can also optionally be in the sulphide form. The metal is preferably supported. More preferably, the catalyst also comprises a support selected from the group formed by: alumina, silica, silica-aluminas, zeolites, activated charcoal, clays and aluminous cement. Mercury is not (or is only slightly) captured by the catalyst but it is activated on the catalyst so that it can be captured in the second step described below. When arsenic is also to be captured, the catalyst is more preferably nickel-based, preferably in the sulphide form and deposited on a support. The metal content of the catalyst is preferably in the range 0.1% to 60% by weight, more preferably in the range 5% to 60% by weight, and more preferably in the range 5% to 30% by weight. When palladium is present, it is preferably present in the range 0.01% to 10% by weight, more preferably in the range 0.05% to 5% by weight. This step is preferably carried out at a temperature in the range 130° C. to 250° C., more preferably in the range 130° C. to 220° C., still more preferably in the range 130° C. to 180° C. The operating pressure is generally in the range 0.1 to 5 MPa, preferably in the range 0.2 to 4 MPa, more preferably in the range 0.5 to 3.5 MPa. The hydrogen flow rate is generally in the range 1 to 500 $h^{-1}$ (volume per volume of catalyst per hour, under normal temperature and pressure conditions).

c) A step c) consisting in passing at least a portion of the effluent from step b) over a mercury capture mass comprising, for example, sulphur and/or at least one sulphur-containing compound, i.e., passing said effluent over at least one adsorbent based, for example, on a metallic sulphide deposited on a support. Advantageously, the technique described in U.S. Pat. No. 4,094,777 or U.S. Pat. No. 4,911,825 is used, preferably a capture mass containing sulphur and possibly a metal that is at least partially in the form of a sulphide. This metal is preferably selected from the group formed by: copper, iron and silver. The quantity of metal that is combined or otherwise in the sulphide form is preferably in the range 0.1% by weight to 20% by weight with respect to the total weight of the capture mass. The amount of elemental sulphur, combined or otherwise, of said mass is advantageously in the range 1% by weight to 40% by weight, and preferably in the range 1% by weight to 20% by weight with respect to the total weight of said mass. Said mass can also comprise a support preferably selected from the group formed by: silica, alumina, silica-aluminas, zeolites, clays, activated charcoal, and aluminous cements. This step is generally operated at a temperature in the range 0° C. to 175° C., preferably in the range 20° C. to 120° C., more preferably in the range 20° C. to 90° C. The operating pressure is generally in the range 0.1 to 5 MPa, preferably in the range 0.2 to 4 MPa, and more preferably in the range 0.5 to 3.5 MPa. The space velocity with respect to the capture mass is generally in the range 1 o 50 $h^{-1}$ (volume of effluent from step b) per volume of capture mass per hour), more preferably in the range 2 to 40 $h^{-1}$, and still more preferably in the range 1 to 30 $h^{-1}$.

EXAMPLE 1

Step a) of the Process of the Invention

A natural gas condensate was injected into a flash drum heated to 180° C. The feed was injected over three minutes to prevent too great a drop in the temperature in the heated drum (T of vapour≅140–160° C.). The feed was condensed on traversing a condenser cooled with cold water (about 15° C.). We then determined the mercury at the head and foot of the drum after a contact time of 10 minutes; mercury and arsenic were recovered overhead. The results are shown below:

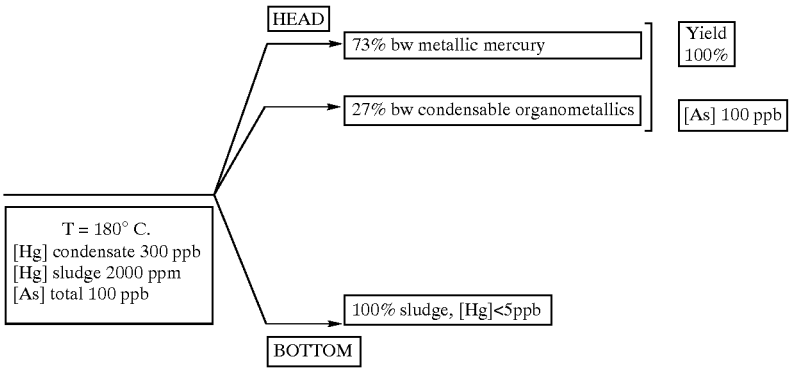

The pre-treated feed could then be sent to the units for steps b) and c).

EXAMPLE 2

Preparation of Catalyst for Step b)

Fifteen kilograms of a macroporous alumina support in the form of beads 1.5–3 mm in diameter and with a specific surface area of 160 $m^2/g$, a total pore volume of 1.05 $cm^3/g$ and a macroporous volume (diameter>0.1 $\mu$m) of 0.4 $cm^3/g$ was impregnated with 20% by weight of nickel in the form of an aqueous nitrate solution. After drying at 120° C. for 5 h and heat activation at 450° C. for 2 h in a stream of air, beads containing 25.4% by weight of nickel oxide were obtained. Five kilograms of these beads were dry impregnated with a solution comprising 175 g of DEODS, diethanoldisulphide (74 g of sulphur) in 5150 $cm^3$ of a 15% methyl formate solution in a gasoline cut (white spirit). The catalyst was then activated at 150° C. for 1 h.

EXAMPLE 3

Preparation of Capture Mass for Step c)

Fifteen kilograms of the support used to prepare catalyst A was impregnated with 10% by weight of copper in the form of an aqueous solution of trihydrated copper nitrate. After drying at 120° C. for 5 h and heat activating at 450° C. for 2 h in a stream of air, beads containing 12.5% by weight of copper oxide were obtained. These beads were then impregnated with a 10% by weight ammonium sulphide solution. The product was activated at 120° C. for 2 h in a stream of nitrogen. This mass was used in reactor II for the example below.

EXAMPLE 4

Steps b) and c) of the Process of the Invention

The test was carried out using two reactors in series: a reactor I (step b) into which the catalyst of Example 2 (50 $cm^3$) was placed, and a reactor II (step c)) located after reactor I, in which the capture mass of Example 3 (50 $cm^3$) was placed. The catalyst was at 180° C. and the mercury capture mass was at 20° C. Both reactors were in upflow mode. The catalyst was reduced at 300° C. in a flow of 20 l/h of hydrogen at a pressure of 2 bars for 6 h. The reactor was cooled to the reaction temperature, namely 180° C. The condensate from step a) (Example 1) was then passed over the catalyst with hydrogen and the effluent obtained was brought into contact with the capture mass. The flow rate for the feed was 400 $cm^3/h$ and that of the hydrogen was 3.5 1/h. The test was carried out at 3.5 MPa of pressure. The condensate used during this test was identical to that of the preceding test.

This produced a final effluent where the mercury and arsenic contents were less than 5 ppb, giving a demercurisation and dearsenification efficiency of more than 99%.

For a proper appreciation of Applicants' invention compared to U.S. Pat. No. 5,384,040, it is important to note that the sludge which remains after vaporizing the hydrocarbon-containing initial feed, is a mass of essentially solid particles which do not boil, even at 600° C. Such solid particles are essentially constituted by metals: at least silicon, aluminum and heavy metals, and in compounds thereof. (Nevertheless, minor amounts of condensed organic compounds may also be absorbed on the sludge or complexed with the metals included in the sludge.) Although sludges can be eliminated through fractional distillation of a heavy cut, sludges do not correspond to a hydrocarbon cut since they have no boiling point for all practical purposes (only a melting point).

In the present invention, the evaporation step results in the precipitation of the sludge and the decomposition of most of the mercury compounds therein to elemental mercury which in turn concentrates in the vapor. The resultant vaporized sludge-free feed is then condensed. By this method, it is possible to retrieve substantially all the organic compounds in the feed, the condensate having almost the same distillation curve as the initial feed. Accordingly, this process differs from the process of U.S. Pat. No. 5,384,040 because of several factors, including but not limited to the separation of sludge.

The preceding examples can be repeated with similar success by substituting the generically or specifically described reactants and/or operating conditions of this invention for those used in the preceding examples. Also, the preceding specific embodiments are to be construed as merely illustrative, and not limitative of the remainder of the disclosure in any way whatsoever.

The entire disclosure of all applications, patents and publications, cited above and below, and of corresponding French application 00/05,839, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A process for capturing mercury and optionally arsenic from a hydrocarbon-containing initial feed comprising sludge, said sludge comprising organometallic mercury compounds, said process comprising:

(a1) vaporizing said hydrocarbon-containing initial feed, thereby partially decomposing the organometallic mercury compounds leaving a solid sludge having a reduced content of mercury compared to the initial feed;

(a2) condensing the resultant vaporized hydrocarbon-containing feed substantially totally to obtain a condensate containing a higher concentration of mercury than said initial feed, steps (a1) and (a2) being conducted without fractional distillation of the initial feed;

(b) contacting resultant condensate from step (a2), with hydrogen and a catalyst so as to at least partially decompose residual organometallic compounds into mercury; and (c) passing resultant hydrogen-treated condensate from step (b) over a mercury capture mass to remove mercury from said resultant hydrogen-treated condensate.

2. A process according to claim 1, wherein step (a1) is operated at a temperature in the range from the temperature of the end point of the feed reduced by 20° C. to the temperature of the end point of the feed increased by 20° C., and at a pressure in the range 0.1 to 5 MPa.

3. A process according to claim 2, wherein step (a2) is operated at a temperature that is lower than that of step (a1) and in the range −10° C. to 500° C., and at a pressure in the range 0.1 to 5 MPa.

4. A process according to claim 3, wherein step (b) is operated at a temperature the range 130° C. to 250° C., a pressure in the range 0.1 to 5 MPa and at a hydrogen flow rate in the range 1 to 500 $h^{-1}$.

5. A process according to claim 4, wherein step (c) is operated at a temperature in the range 0° C. to 175° C., a pressure in the range 0.1 to 5 MPa, and at a space velocity in the range 1 to 50 $h^{-1}$.

6. A process according to claim 1, wherein the catalyst comprises sulphided nickel, said catalyst being also capable of capturing arsenic.

7. A process according to claim 1, wherein the catalyst comprises at least one metal selected from the group consisting of nickel, cobalt, iron and palladium, and wherein at least 50% of said metal is in the reduced state.

8. A process according to claim 7, wherein the catalyst comprises a support selected from the group consisting of alumina, silica, silica-aluminas, zeolites, activated charcoal, clays and aluminous cements.

9. A process according to claim 1, wherein the capture mass contains sulphur and a metal at least partially in the form of a sulphide.

10. A process according to claim 9, in which the metal is selected from the group consisting of copper, iron and silver.

11. A process according to claim 9, wherein the quantity of metal combined or otherwise in the form of the sulphide is in the range 0.1% by weight to 20% by weight with respect to the total weight of the capture mass, and the quantity of elemental sulphur, combined or otherwise, of said mass is in the range of 1% by weight to 40% by weight.

12. A process according to claim 11, wherein the capture mass also comprises a support selected from the group consisting of silica, alumina, silica-aluminas, zeolites, clays, activated charcoal and aluminous cements.

* * * * *